US009151452B2

(12) United States Patent
Chiang

(10) Patent No.: US 9,151,452 B2
(45) Date of Patent: Oct. 6, 2015

(54) FLUORESCENT LAMP WITH NEW LED TUBE

(71) Applicant: Hung Chiang, Pingtung County (TW)

(72) Inventor: Hung Chiang, Pingtung County (TW)

( * ) Notice: Subject to any disclaimer, the term of this patent is extended or adjusted under 35 U.S.C. 154(b) by 161 days.

(21) Appl. No.: 14/141,674

(22) Filed: Dec. 27, 2013

(65) Prior Publication Data

US 2015/0009650 A1 Jan. 8, 2015

(30) Foreign Application Priority Data

Jul. 3, 2013 (TW) ..... 102212494 U

(51) Int. Cl.

| | |
|---|---|
| ***F21V 23/02*** | (2006.01) |
| ***F21K 99/00*** | (2010.01) |
| ***F21S 8/00*** | (2006.01) |
| *F21Y 101/02* | (2006.01) |
| *F21Y 103/00* | (2006.01) |

(52) U.S. Cl.

CPC ..... *F21K 9/175* (2013.01); *F21S 8/031* (2013.01); *F21V 23/026* (2013.01); *F21K 9/17* (2013.01); *F21Y 2101/02* (2013.01); *F21Y 2103/003* (2013.01)

(58) Field of Classification Search

CPC ..... F21K 9/175; F21K 9/17; F21S 8/031; F21V 23/026; F21Y 2101/02; F21Y 2103/003

USPC ..... 362/221, 222, 223, 225, 217.1, 217.14

See application file for complete search history.

(56) References Cited

U.S. PATENT DOCUMENTS

| | | | | |
|---|---|---|---|---|
| 2010/0264831 | A1* | 10/2010 | Nagaoka | 315/149 |
| 2012/0306342 | A1* | 12/2012 | Dellian et al. | 313/46 |
| 2014/0146536 | A1* | 5/2014 | Li | 362/249.02 |
| 2014/0203716 | A1* | 7/2014 | Tao | 315/186 |

* cited by examiner

*Primary Examiner* — Ali Alavi

(74) *Attorney, Agent, or Firm* — Rosenberg, Klein & Lee

(57) ABSTRACT

A fluorescent lamp with a new LED tube is revealed herein to have at least one terminal socket at both sides of a lamp holder for terminals disposed at both sides of the LED tube to be plugged therein, wherein each terminal socket in the lamp holder is coupled with each of plural second substrates assembled with a filter inductor, and a rectifier diode disposed on a first substrate having light emitting diodes in the LED tube for output of a DC power with high or low voltage constant current suitably used in the light emitting diodes, so that the power efficiency for the light emitting diodes of the LED tube can be improved, the heating temperature of the light emitting diodes can be lowered and the life span for the LED tube can get longer.

8 Claims, 5 Drawing Sheets

FLUORESCENT LAMP WITH NEW LED TUBE

BACKGROUND OF THE INVENTION

1. Fields of the Invention

The present invention relates to a fluorescent lamp with a new LED tube having a filter inductor and a rectifier diode for output of a DC power with high or low voltage constant currents.

2. Descriptions of Related Art

A fluorescent lamp fixture mainly links a lamp tube and a power for driving the lamp tube to glow. Fluorescent lamp tubes prevail over lighting markets at the present time, but they need to be excited to glow by high voltage. Therefore, a stabilizer and a starter are necessarily equipped on the existing fluorescent lamp fixture to transfer the mains supply into high voltage power for driving the fluorescent lamp tube to glow. Since the fluorescent lamp tube must use mercury gas to produce visible light, the mercury will cause serious pollution in the surrounding environment. Therefore, a LED tube with advantages of the eco-friendliness and energy saving gradually replaces an existing fluorescent lamp tube.

The existing LED tube with a length ranging from 1200 mm to 1210 mm or from 588 mm to 590 mm includes an electronic transformer disposed therein, and it is suitable only for low voltage DC power. However, on a basis of the power outputted through the stabilizer and the starter having hundreds of volts high voltage, directly installing a conventional LED tube on a lamp fixture by user will cause the LED tube to burn quickly due to a surged high voltage power. Therefore, in present practices, steps for cutting the wiring among a stabilizer, a starter and the lamp fixture, and connecting the supply mains AC power to the lamp fixture, must be done prior to installment of the LED tube in the lamp fixture. However, for the users unfamiliar with any wiring technologies, the aforesaid approach of installment has a great inconvenience and difficulty. Also, a conventional LED tube is designed without any stabilizers or starters, but an electronic transformer disposed into a cooling aluminum tube, which will easily cause failure of the electronic transformer due to a high temperature within the aluminum tube, so as further to shorten the life of the electronic transformer, result in a possible increasing amount of garbage as well as cause environmental pollutions.

Accordingly, a conventional fluorescent lamp fixture with a stabilizer and a starter cannot be compatible with a conventional LED tube, and an electronic transformer for use in the conventional LED tube includes quite a few electronic components, which not only reflects a high cost, but also generates much waste heat in operation thereof. The existing electronic transformer will cause a high temperature during operation thereof so that it will be subject to burning, damages or the like. Meanwhile, the electronic components which constitute the electronic transformer also contain lots of hazardous substances of heavy metals detrimentally affecting our living environment. In case of inadvertently disposing those hazardous substances, it will cause serious damages to the environment.

SUMMARY OF THE INVENTION

Therefore, a fluorescent lamp with a new LED tube is developed herein. A primary objective of the present invention is to provide a fluorescent lamp with a new LED tube having a filter inductor and a rectifier diode for output of a DC power with high or low voltage constant currents.

In order to achieve the above objectives, a fluorescent lamp with a new LED tube of the present invention is revealed herein to comprise:

at least one LED tube having a tube body, a plurality of terminals disposed at both sides of the tube body, a first substrate disposed inside the tube body for coupling to the terminals, a plurality of light emitting diodes disposed on the first substrate, and a rectifier diode fitted in a circuit between the terminals and light emitting diodes; and a lamp holder having a main body, at least one terminal socket disposed at both sides of the main body corresponding to each other to constitute a group at both sides of the main body for terminals plugged therein, a plurality of second substrate inside the main body each coupled with each of the at least one terminal socket, and a filter inductor fitted on each of the second substrates.

The filter inductor is provided with an inductive body of electromagnetic steel sheets, a copper induction coil wound around the inductive body and a pin for plugging the second substrate of the lamp holder.

The second substrate in the main body of the lamp holder further has a socket for the filter inductor plugged therein.

The tube body of the LED tube has a length ranging from 1200 mm to 1210 mm.

The tube body of the LED tube has a length ranging from 588 mm to 590 mm.

Accordingly, the fluorescent lamp with a new LED tube of the present invention uses the filter inductor disposed in the lamp holder to transfer mains supply into a power supply with low frequency high voltage or low voltage constant current, and then AC power of the mains supply is further transferred into DC power by the rectifier diode for output of a DC power with high or low voltage constant current suitably used in the LED tube. In this way, the power efficiency for the LED tube can be improved, the heating temperature of the same be lowered and the life span for the same get longer.

BRIEF DESCRIPTION OF THE DRAWINGS

The structure and the technical means adopted by the present invention to achieve the above and other objects can be best understood by refereeing to the following detailed description of the preferred embodiments and the accompanying drawings, wherein.

DETAILED DESCRIPTION OF THE PREFERRED EMBODIMENT

Figure 1:
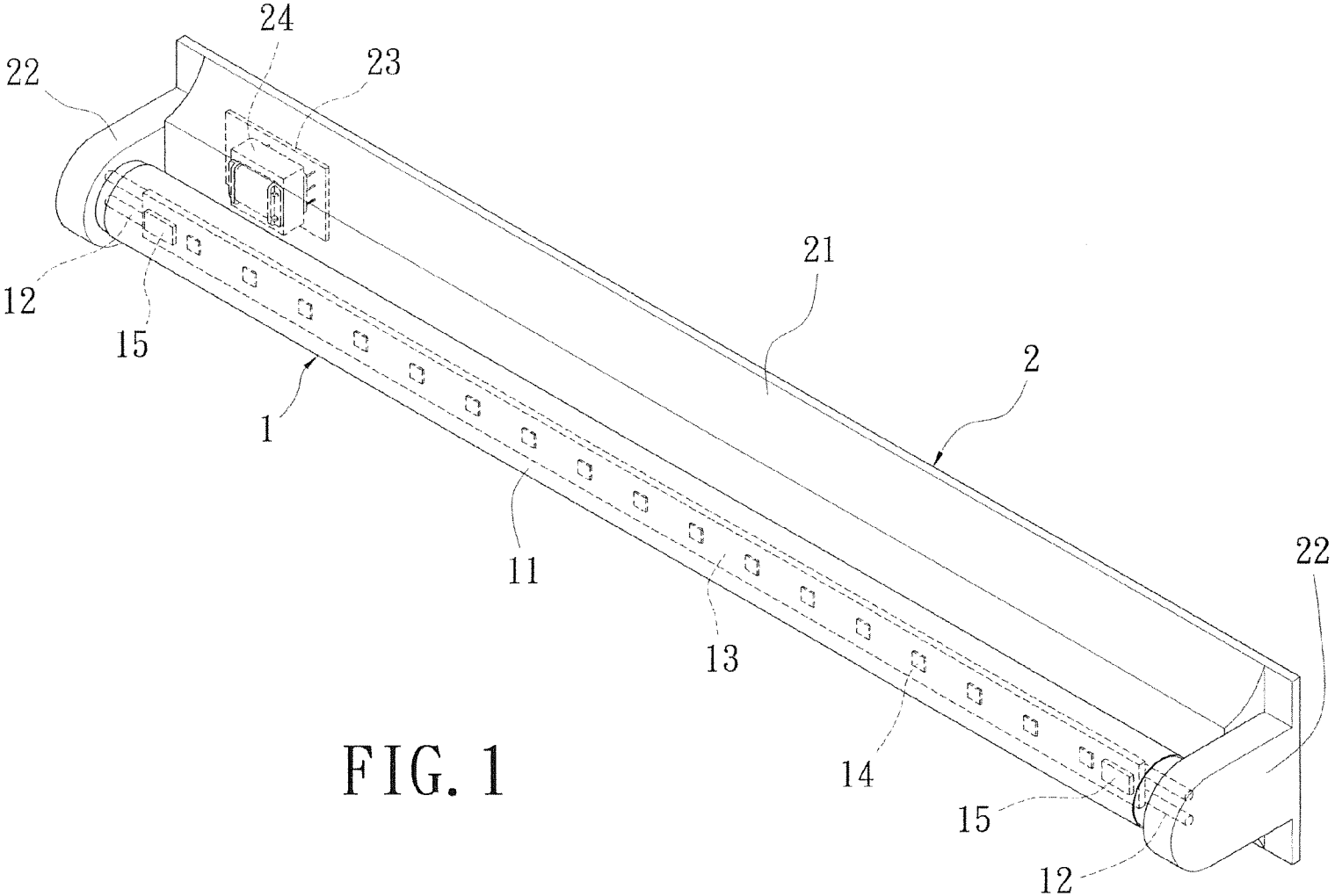
FIG. 1 is a perspective view showing structure of an embodiment of a fluorescent lamp with a new LED tube according to the present invention.
Figure 2:
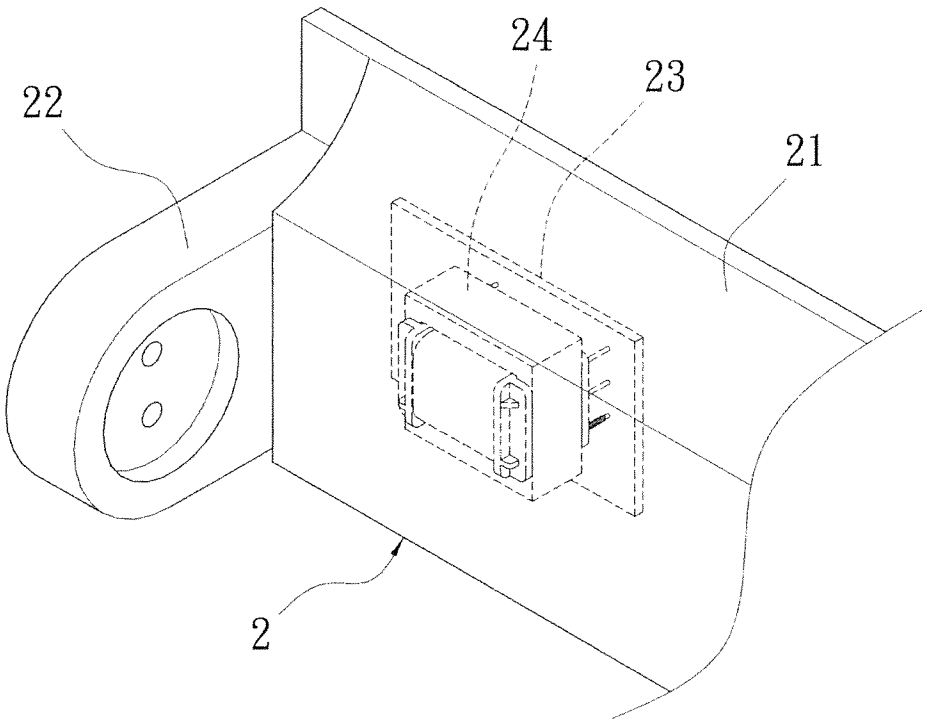
FIG. 2 is a partial enlarged view showing structure of an embodiment of a fluorescent lamp with a new LED tube according to the present invention.
Figure 3:
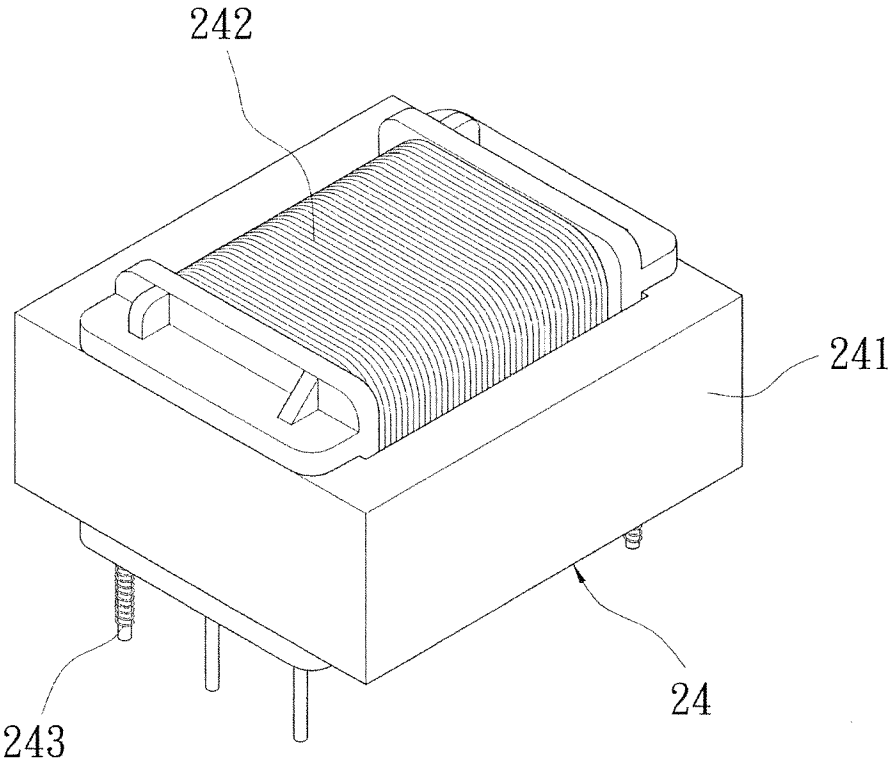
FIG. 3 is a perspective view showing structure of a filter inductor of the present invention.

As referring to FIG. 1 and FIG. 2, a fluorescent lamp with a new LED tube comprising, at least one LED tube (1), having a tube body (11), a plurality of terminals (12) disposed at both sides of the tube body (11), a first substrate (13) disposed inside the tube body (11) for coupling to the terminals (12), a plurality of light emitting diodes (14) disposed on the first substrate (13), and a rectifier diode (15) fitted in a circuit (not shown) between the terminals (12) and the light emitting diodes (14), wherein the tube body (11) of the LED tube (1) has a length ranging from 1200 mm to 1210 mm or from 588 mm to 590 mm. As a result, there is no need to install any electronic transformers in the LED tube (1) herein.

a lamp holder (2), having a main body (21), at least one terminal socket (22) disposed at both sides of the main body (21) corresponding to each other to constitute a group at both sides of the main body (21) for the terminals (12) plugged therein, a plurality of second substrates (23) inside the main body (21) each coupled with each of the at least one terminal socket (22), and a filter inductor (24) fitted on each of the second substrate (23). As further referring to FIG. 3, the filter inductor (24) is provided with an inductive body (241) of electromagnetic steel sheets, a cooper coil (242) wound around the inductive body (241) and a pin (243) for plugging the second substrate (23) of the lamp holder (2).

In a specific implementation of the present invention, as referring FIG. 1 again, the LED tube (1) is disposed between the at least one terminal socket (22) of the lamp holder (2), and then allow the terminals (12) at both sides of the LED tube (1) to be plugged in each of the at least one terminal socket (22), so that the LED tube (1) can be further coupled to the filter inductor (24) in the lamp holder (2) by connecting of the terminals (12) to the terminal socket (22) in the lamp holder (2).

As to initiation of the LED tube (1) for lighting purposes, it can be completed by turning on and input of the mains supply to the second substrate (23) of the lamp holder (2) through a power line and the same further flowing to the terminals (12) of the LED tube (1) connected to the terminal sockets (22) through a path between the filter inductor (24) coupled to the substrate (23) and the terminal socket (22). In this way, the mains supply can flow from the terminals (12) of the LED tube (1) to the light emitting diodes (14) via the rectifier diode (15) for allowing the light emitting diodes (14) to emit light.

When the mains supply flows through the filter inductor (24) of the lamp holder (2), the filter inductor (24) is able to rise or lower voltages, fix currents and filter frequency of the mains supply so that the mains supply which flows to the LED tube (1) is changed to a high or low voltage constant current state, and the mains supply with high or low voltage constant current flows again to the rectifier diode (15) of the LED tube (1), the rectifier diode (15) transfers the mains supply AC power into DC power for use in the light-emitting diodes (14). Therefore, after rising and lowering voltage, fixing current and filtering in the filter inductor (24) and AC/DC power transference in the rectifier diode (15), a DC power with high or low voltage constant current for use in the light emitting diodes (14) can be outputted. In this way, the power efficiency for the light emitting diodes (14) of the LED tube (1) can be improved, the heating temperature of the light emitting diodes (14) be lowered and the life span for the LED tube (1) get longer.

Furthermore, the fluorescent lamp with a new LED tube in the present invention uses the filter inductor (24) to replace any stabilizers and starters disposed in a conventional fluorescent lamp. The filter inductor (24) cannot only effectively transfer the mains supply into the power with high or low voltage constant current suitably used in the light emitting diodes (14) for increasing the power efficiency thereof, but also its simple structure reflects relatively significant low costs. Meanwhile, waste heat generated in operation thereof can also be lowered to reduce a failure rate thereof In addition, because of the simple structural assembly of the inductive body (241) made of electromagnetic steel sheets and a cooper coil (242), it will not cause environmental pollutions and substantially reduce wastes.

Figure 4:
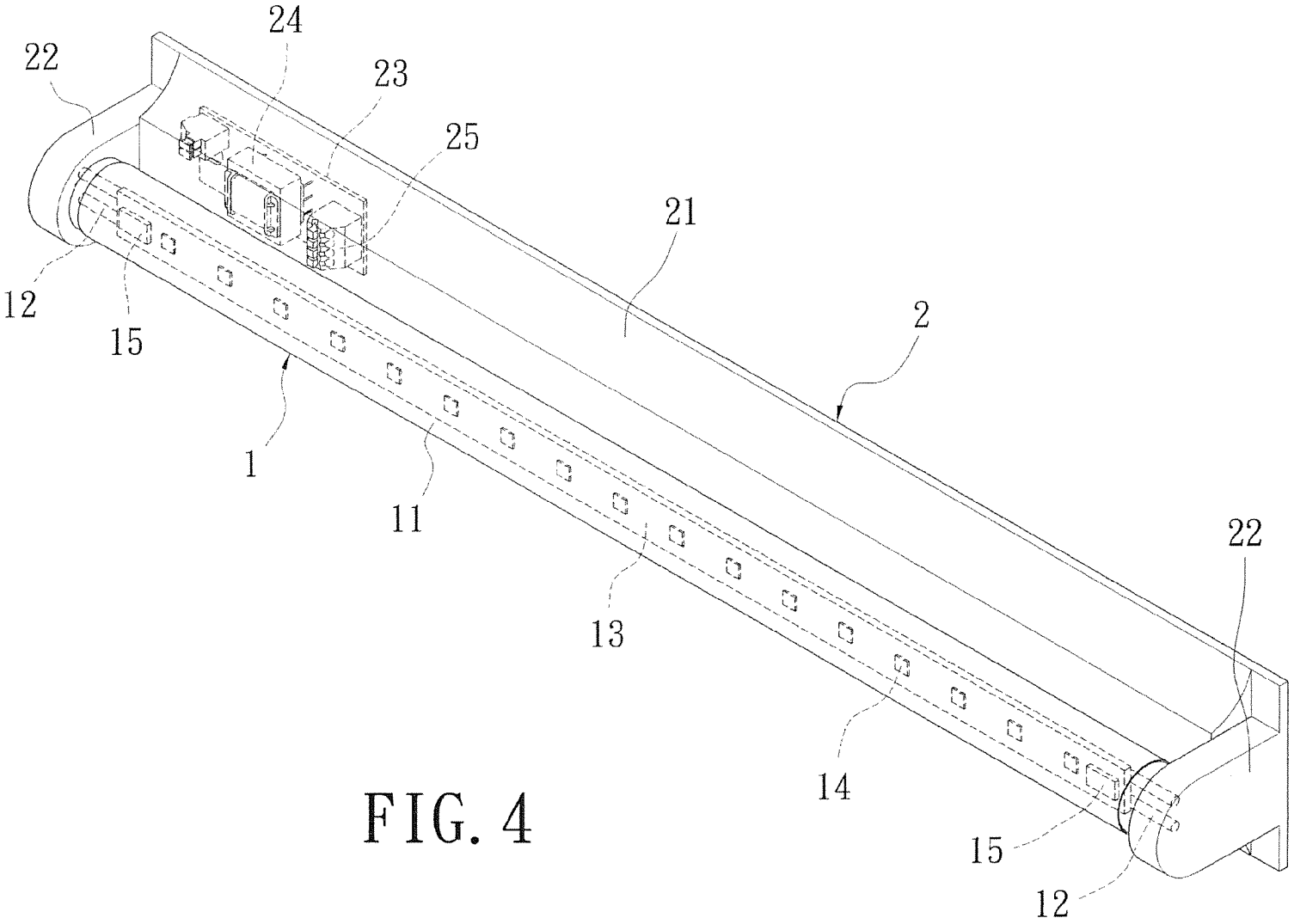
FIG. 4 is a perspective view showing structure of another embodiment of a fluorescent lamp with a new LED tube according to the present invention.
Figure 5:
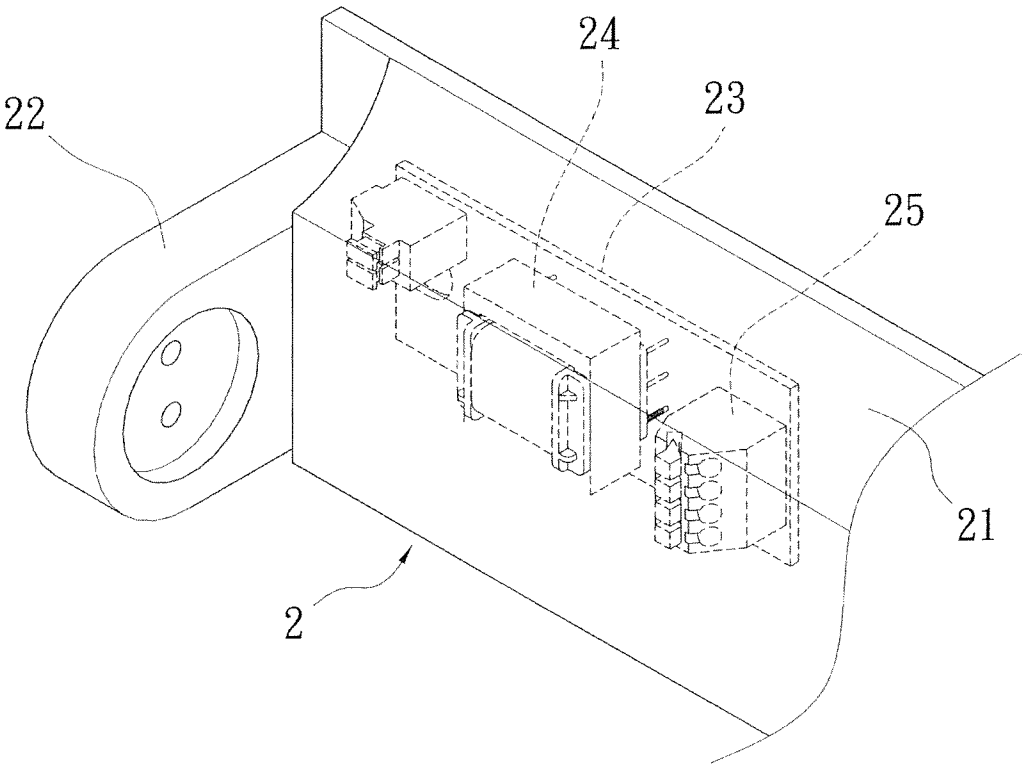
FIG. 5 is a partial enlarged view showing structure of another embodiment of a fluorescent lamp with a new LED tube according to the present invention.

The above embodiment and figures are not to limit the implementation modality of the fluorescent lamp with the new LED tube in the present invention. As referring FIG. 4 and FIG. 5, the pin (243) of the filter inductor (24) in the fluorescent lamp with the new LED tube of the present invention can be directly plugged in a socket (25) disposed on each second substrate (23) within the lamp holder (2), so that the filter inductor (24) couples to the second substrate (23) and the terminal socket (22) to increase the convenience in assembling the filter inductor (24). Various modifications, additions and alterations can be made by one skilled in the art without departing from the scope or spirit of the present invention. Therefore, it should be clearly understood that the form of the present invention described above and shown in the figures of the accompanying drawing is illustrative only and is not intended to limit the scope of the present invention.

What is claimed is:

1. A fluorescent lamp with a new LED tube, comprising:

at least one LED tube having a tube body, a plurality of terminals disposed at both sides of the tube body, a first substrate disposed inside the tube body for coupling to the terminals, a plurality of light emitting diodes disposed on the first substrate, and a rectifier diode fitted in a circuit between the terminals and the light emitting diodes; and a lamp holder having a main body, at least one terminal socket disposed at both sides of the main body corresponding to each other to constitute a group at both sides of the main body for the terminals plugged therein, a plurality of second substrates inside the main body each coupled with each of the at least one terminal socket, and a filter inductor fitted on each of the second substrates.

2. The fluorescent lamp tube with a new LED tube as claimed in claim 1, wherein the filter inductor is further provided with an inductive body of electromagnetic steel sheets, an induction coil wound around the inductive body and a pin for plugging the second substrate of the lamp holder.

3. The fluorescent lamp tube with a new LED tube as claimed in claim 2, wherein the second substrate in the main body of the lamp holder further has a socket for the filter inductor plugged therein.

4. The fluorescent lamp tube with a new LED tube as claimed in claim 3, wherein the tube body of the LED tube has a length ranging from 1200 mm to 1210 mm.

5. The fluorescent lamp tube with a new LED tube as claimed in claim 3, wherein the tube body of the LED tube has a length ranging from 588 mm to 590 mm.

6. The fluorescent lamp tube with a new LED tube as claimed in claim 1, wherein the filter inductor is provided with an inductive body of electromagnetic steel sheets, a copper induction coil wound around the inductive body and a pin for plugging the second substrate of the lamp holder.

7. The fluorescent lamp tube with a new LED tube as claimed in claim 1, wherein the tube body of the LED tube has a length ranging from 1200 mm to 1210 mm.

8. The fluorescent lamp tube with a new LED tube as claimed in claim 1, wherein the tube body of the LED tube has a length ranging from 588 mm to 590 mm.

* * * * *